United States Patent [19]

Christoffel, Jr.

[11] 4,029,273

[45] * June 14, 1977

[54] KITE

[76] Inventor: Julius M. Christoffel, Jr., 5323 Yarwell, Houston, Tex. 77035

[ * ] Notice: The portion of the term of this patent subsequent to Apr. 9, 1988, has been disclaimed.

[22] Filed: Nov. 13, 1975

[21] Appl. No.: 631,534

Related U.S. Application Data

[63] Continuation of Ser. No. 507,342, Sept. 19, 1974, abandoned, which is a continuation of Ser. No. 320,470, Jan. 2, 1973, abandoned.

[52] U.S. Cl. ..... 244/153 R

[51] Int. Cl.[2] ..... B64C 31/06

[58] Field of Search ..... 244/153 R, 154, 155 R, 244/DIG. 1; 46/89; D34/15 AF

[56] References Cited

UNITED STATES PATENTS

| | | | |
|---|---|---|---|
| 1,009,274 | 11/1911 | Ayling | 244/153 R |
| 1,641,607 | 9/1927 | Spatz | 46/89 |
| 2,431,289 | 11/1947 | Whaley | 244/153 R |
| 3,018,075 | 1/1962 | Bowers | 244/153 R |
| 3,086,737 | 4/1963 | Hyman | 244/153 R |
| 3,093,354 | 6/1963 | Pohl | 244/154 |
| 3,330,512 | 7/1967 | Null | 244/153 R |
| 3,335,985 | 8/1967 | Neal | 244/153 R |
| 3,347,500 | 10/1967 | Hartig | 244/153 R X |
| D223,716 | 5/1972 | Choong | D34/15 AF |
| D231,245 | 4/1974 | Christoffel | D34/15 AF |

FOREIGN PATENTS OR APPLICATIONS

| | | | |
|---|---|---|---|
| 385,226 | 5/1908 | France | 244/155 R |
| 1,085,385 | 2/1955 | France | 46/89 |
| 614,064 | 12/1960 | Italy | 244/16 |

OTHER PUBLICATIONS

Aviation Week and Space Technology, Oct. 8, 1962, p. 32.

*Primary Examiner*—Trygve M. Blix
*Assistant Examiner*—Barry L. Kelmachter
*Attorney, Agent, or Firm*—Bard, Springs, Jackson & Groves

[57] ABSTRACT

An inflatable delta wing kite having a single air chamber formed of a bulbous nose portion and three frusto conical shaped tubular portions forming structural beams, one beam extending along the central longitudinal axis, and the other two forming the leading edges of the kite, the terminal end of the central beam forming a filler tube; generally triangularly shaped, uninflated sections forming airfoils are located between the central and edge beams. The kite has a laterally extending string attaching member having a plurality of string locations, and a pendulum-like gravity stabilizer attached to the terminal end of the central beam. A method for fabricating the kite is also disclosed.

10 Claims, 8 Drawing Figures

KITE

This is a continuation of application Ser. No. 507,342, filed Sept. 19, 1974, now abandoned which is a continuation of application Ser. No. 320,470, filed Jan. 2, 1973, now abandoned.

BACKGROUND OF THE INVENTION

1. Field of the Invention

The present invention relates to kites and more particularly to the construction of a novel inflatable kite and its method of manufacture.

2. Brief Description of the Prior Art

Numerous kite constructions have been proposed in which the kite is formed of two sheets of gas impervious plastic having portions which are sealed together to form at least one inflatable chamber. When inflated, the kites form various shapes from the diamond-like shape of a conventional two-stick kite to those shaped like modern rockets. The air chamber rather than sticks provides the kite's rigidity.

Some of the prior art inflatable kites have only a single air chamber. In such case, there are usually similar surfaces forming both faces of the kite, and the kite reacts as a balloon and not as a true airfoil. In one case, the inflatable kite is generally T-shaped with the cross-arm as the top of the kite. This kite is provided with webs between the cross-arms and stem which are intended to respond as airfoils; however, they do little more than act as stabilizers. The kite's flight is due primarily to lift obtained through air resistance and has a low angle of flight. If erratic winds find a track across the similar upper and lower surfaces of such a kite, the kite will head down to the ground unless its trailing tail can stabilize it and head it back into the wind.

Other prior art inflatable kites have a plurality of interconnecting air chambers. Due to the seals between the chambers, there is a hinge effect and most multi-chambered kites tend to collapse or change configuration if there is any substantial wind.

In summary, most of the prior art inflatable kites have been air resistant flyers and fly against the wind rather than being effective airfoils and as a consequence have a low angle of flight; have been difficult to maintain in a stable flying attitude, particularly in erratic winds; have not been sufficiently rigid to maintain their predetermined shape; have been difficult to balance laterally; and have not been designed to take advantage of modern techniques of mass production.

SUMMARY OF THE INVENTION

To overcome the disadvantages of the various prior art inflatable kites, the present invention discloses a delta wing shaped inflatable kite having a single air chamber and two uninflated sections which automatically respond as airfoils when the kite is in flight. The air chamber has a bulbous nose portion from which three structural beams extend. One beam portion extends along the central longitudinal axis of the kite and the other two beam portions establish the leading edges of the kite. An airfoil is located between the central beam and each edge beam. The single air chamber with its structural beams forms a rigid construction which maintains the configuration of the kite even in buffeting winds. The delta wing shape has proven to be a most effective aerodynamic shape for a kite and the uninflated sections acting as automatic airfoils provides additional lift. Rather than being a simple air resistant flyer the novel kite flies through the wind with a relatively high angle of flight.

A laterally extending string attaching member having multiple string attaching locations extends along a lateral axis which perpendicularly intersects the central longitudinal axis at the flying point. Such member facilitates achieving lateral balance. The kite may also be provided with one or more weighted members attached to the terminal end of the central beam to form a pendulum-like gravity stabilizer which will instantaneously right the kite should erratic winds tend to keel it over.

The new kite being in the shape of an isosceles triangle permits simultaneous production of two kites without any waste of material.

It is an object of the present invention to provide an improved inflatable delta wing kite having a single air chamber and responsive airfoils which provide a rigid construction and improved flying characteristics.

It is another object to provide an inflatable kite with a laterally extending string attaching member having a plurality of string attaching locations so that lateral balance may be easily obtained.

It is a further object to provide an inflatable kite with a pendulum-like gravity stabilizer which will automatically right the kite should it be affected by erratic winds while in flight.

It is still another object to provide an inflatable kite which is so designed that it may be produced from tubular or sheet stock on a mass production basis with a minimum of waste Other objects and many of the attendant advantages of this invention will be readily appreciated to those skilled in the art from consideration of this specification, including the accompanying drawings in which like reference numerals designate like parts throughout the figures thereof:

DETAILED DESCRIPTION OF THE SPECIFIC EMBODIMENT

Figure 1:
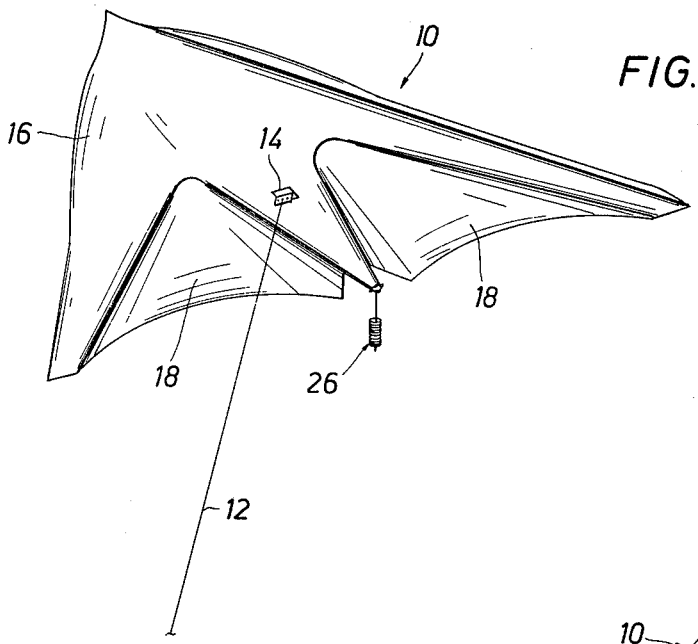
FIG. 1 is a perspective view of the kite of the present invention in flight.
Figure 2:
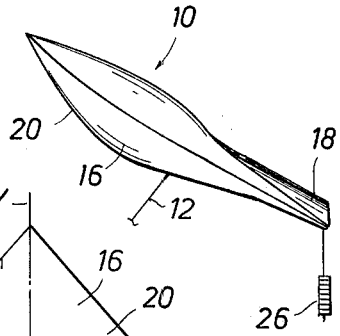
FIG. 2 is a side elevational view of the kite shown in FIG. 1.

Reference will now be made to the drawings wherein FIGS. 1 and 2 illustrate an inflatable kite 10 of the present invention in flight. Kite 10 has the general configuration of a delta shaped wing, a shape which has been found to have very desirable flying characteristics in rigidly supported kites. A tethering string 12 is attached to a multiple location string attaching member 14 secured to the kite as will be more fully explained subsequently.

Figure 5:
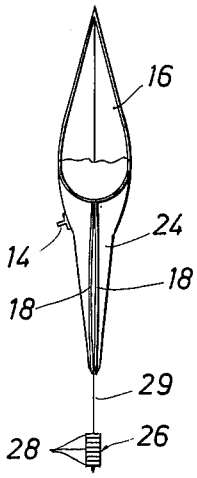
FIG. 5 is a section view taken generally along lines 5–5 of FIG. 4.
Figure 4:
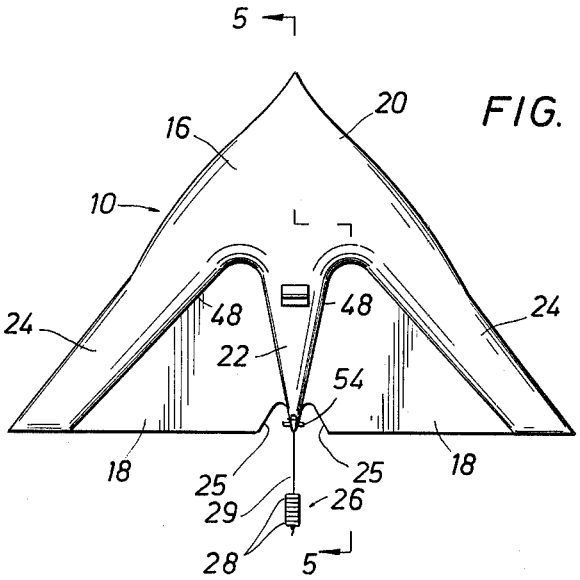
FIG. 4 is a view similar to FIG. 3 with the kite inflated.

The kite 10 has a single air chamber 16 and two airfoils 18–18. Air chamber 16 is formed of a bulbous nose portion 20 and three generally frusto-conically shaped, tubular portions which form structural beams. One beam 22 extends along the central longitudinal axis Y of the kite and the other two beams 24—24 form the leading edges of the kite. The three beams in conjunction with the bulbous nose and the airfoils provide structural integrity for the kite and enables it to remain rigid in relatively high winds. As can be seen from FIGS. 4 and 5, kite 10 is symmetrical on both sides of perpendicular planes extending through the longitudinal axis Y. Although the top surface of air chamber 16 is similar in shape to the bottom surface in unstressed condition, under normal pressurization there will be a slight longitudinal bow when in flight, see FIG. 2.

Airfoils 18—18 are formed from forwardly extending, generally triangularly shaped uninflated sections which are located between central beam 22 and each edge beam 24. Separating the terminal end of central beam 22 from the airfoils 18—18 are notches 25–25.

It has been found from actual tests that kite 10 has excellent flying characteristics. While prior art inflatable kites are difficult to get above house top level except under excellent flying conditions, kite 10 will normally fly very high and string angle is often in excess of 45°. While most inflatable kites fly against the wind and obtain their lift from the vertical vector resulting from the splitting windstream, kite 10 has uninflated sections which automatically flare upwardly and outwardly as the airstream contacts the forward face of the kite, see FIGS. 1 and 2. Such action forms airfoils 18—18 which provide additional lift. Therefore, kite 10 actually flies on the airstream rather than just against the wind.

While the kite is very stable in light winds, i.e., 8 to 10 miles per hour, without any tail or stabilizing means, it has been found that in high erratic wind situations the use of a weighted pendulum-like gravity stabilizer 26 is very desirable. The stabilizer may be formed of a plurality of weighted members, such as washers 28 attached by a string 29 to the terminal end of central beam 22. If an inflated kite has similar top and bottom surfaces and erratic cross winds find a track across the similar top and bottom surfaces, one side will start to dip and the effect will be rapidly compounded and the kite will head toward earth. If such a kite has a conventional trailing tail, the tail will tend to offset such action but the reaction time is relatively slow and often ineffective. However, it has been found that will the gravity stabilizer 26 if cross winds start to kneel the kite over, the stabilizer will immediately go into effect, drop the tail lower than the dipping side thereby righting the kite and again facing it into the wind and a stable condition. The reaction time with stabilizer 26 is much faster than a conventional type tail. Also it has been found that much less weight is needed for stabilizer 26 than would be required for a conventional type tail that would be of any substantial value. Since weight is a critical factor in obtaining high angle flight, the lighter pendulum-like stabilizer is most advantageous.

Figure 7:
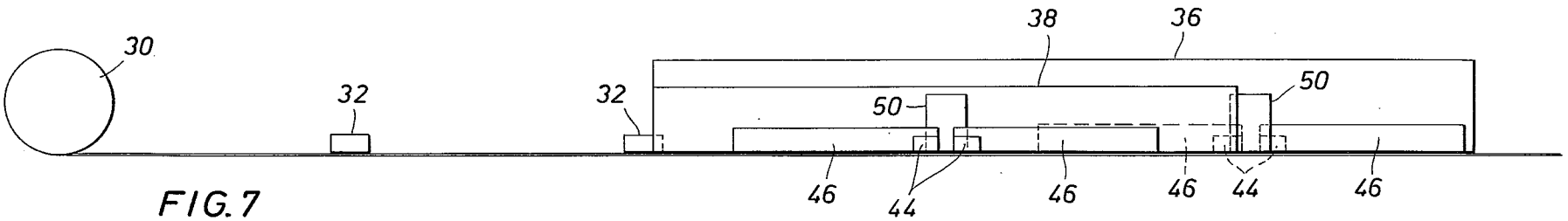
FIG. 7 is a diagrammatic view illustrating the manufacturing of the kite.

Kite 10 not only has excellent flying chracteristics but it also has been designed to be effectively and rapidly produced by mass production means with a minimum of material waste. One method of producing kite 10 is illustrated in FIGS. 7 and 8.

A roll 30 of plastic material, such as heat sealable polyethylene, either in tubular or double sheet form is transported to a pair of shear cutting dies 32—32, one on either side of roll 30 which notch the material. One die is longitudinally spaced from the other such that one notch 34 is at the terminal end of the central beam of a first kite to be produced and the other notch 34 is at the terminal end of the central beam of the next adjacent kite sought to be produced. The material that is notched is then moved forward until the notches are properly aligned with a set of heat cutting and sealing dies 36 which produces two kites simultaneously. The dies have a hot cutting and sealing unit 38 having two cutting wires 40, and which also simultaneously seal the four cut edges. One wire cuts and seals edges 40A and 40B and another wire cuts and seals edges 40C and 40D. The sides 40B and 40C form the leading edges of one of the two kites being simultaneously produced. Side 40D forms one leading edge of the second kite which has for its other leading edge side 40A which was produced from the previous application of the die.

The die 36 also has two sets of hot cutting units 44—44 which cut generally triangular shaped notches 25—25 on each side of each notch 34. The die 36 also has two sets of heat sealing units 46—46 forming seals 48—48 which establish the interior configurations of the air chamber and establish the structural beams and airfoils. Locating means 50 may be provided to guide the securing of the string attaching means 14 to the kite 10.

Figure 8:
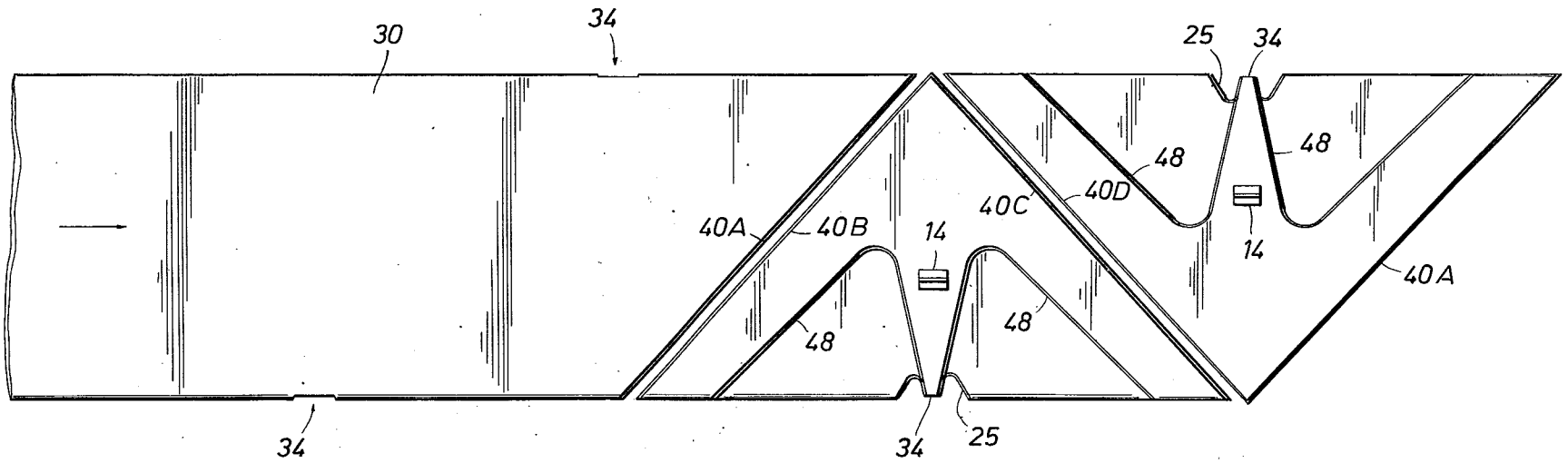
FIG. 8 is a diagrammatic view illustrating the steps of forming the kite.

As will be apparent from a study of FIG. 8, the preferred method of manufacturing embodiments of the kite 10 can be performed without waste of significant amount of material. Since each kite 10 is in the form of an isosceles triangle, the cutting of the side of one kite simultaneously produces the side of a second kite, therefore each application of cutting and heat-sealing die 36 simultaneously forms and seals the four leading edges and forms air chamber seals for two kites.

Figure 3:
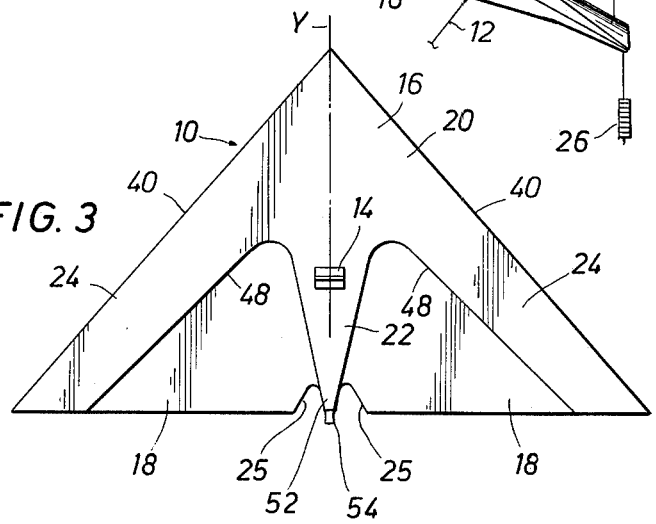
FIG. 3 is a bottom plan view of the kite uninflated.

Kite 10 produced by the foregoing method is illustrated in uninflated condition in FIG. 3. In outline it forms an isosceles triangle with the apex angle less than ninety degrees; however, the apex angle may be greater if desired. The sides 40 of the two layers of material are joined together by heat seals which are formed simultaneously with the cutting of the sides. Heat seals 48—48 divide the interior of the triangle into air chamber 16 and airfoils 18—18. As mentioned, air chamber 16 has three structural beams 22 and 24—24 extending from nose portion 20. If tubular stock is used, the ends of beams 24—24 are closed and the end of central beam 22 is notched to form a filler tube 52 for air chamber 16. For easy filling, a short piece of hollow tube 54 may be inserted in the open end of central beam 22. After the air chamber is filled, tube 54 is withdrawn. The terminal portion of the end of central beam 22 may be bent back over itself and tube 54 and a rubber band or string used to secure the end and close the air passage, see FIG. 4.

Figure 6:
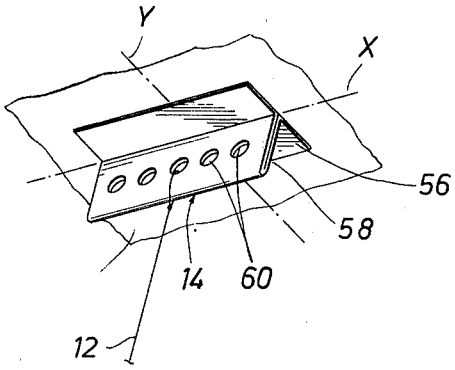
FIG. 6 is an enlarged perspective view of the string attaching member.

Although kites 10 are produced on a mass production basis and all kites so produced are virtually indentical, it has been found that due to slight variations in material, heat seals and other variables, lateral balance does not always occur on the theoretical longitudinal central axis Y. It has also been ascertained that lateral balance is very important in flying the kite under other than ideal conditions. Therefore, kite 10 may be provided with multiple location string attaching means 14 shown in FIG. 6. Means 14 may be formed of a tough fibrous material folded into a T-shape having a cross-arm 56 which is securely attached to the kite and a stem 58 which has a plurality of string attaching locations 60. Member 14 extends along a lateral axis X which perpendicularly intersects the central longitudinal axis Y at the flying point of the kite which has been determined empirically for kite 10 to be approximately three-fifths of the distance down from the apex. If it is determined by the flyer that the kite is not in lateral balance for the particular flying conditions, string 12 may be moved to a different location 60 to achieve lateral balance.

In summary, kite 10 being delta wing shaped and having a single air chamber with a bulbous nose and three structural beams and two airfoils is sufficiently rigid and has excellent flying characteristics and responds as a true airfoil rather than simply as an air resistant member. The pendulum-like gravity stabilizer maintains the kite stable even in erratic cross wind while the multiple location string attaching member permits individual lateral balance. Since the kite has a high angle of flight and will reach great heights, it would make an excellent rescue marker particularly if it is made of radar reflection material. Moreover, the kite is amenable to mass production with no waste of material.

What is claimed is:

1. An inflatable kite formed of two layers of plastic having an outline forming the configuration of the kite, the two layers being secured together to form at least one inflatable air chamber, the kite having a central longitudinal axis, a string attaching member formed of an elongated member having an arm portion and a stem portion extending downwardly from the underside laterally along an axis perpendicularly intersecting the central longitudinal axis approximate the flying point of the kite, the stem portion having a plurality of string attaching locations spaced along its length.

2. The kite specified in claim 1 including an inflating means formed by having an open end in a portion extending along the central longitudinal axis, means for closing the inflating means after the kite is inflated, a flexible cord for attachment to the closed inflating means, and a pendulum-like gravity stabilizer formed of at least one weighted member for attachment to the flexible cord.

3. The kite specified in claim 1 wherein the kite has a single inflatable chamber, means to inflate the chamber, and two uninflated areas, the chamber and the uninflated areas being shaped and arranged whereby when the chamber is inflated a kite having a generally deltoid configuration with two gull-wing shaped airfoils results.

4. The kite specified in claim 3 including a pendulum-like gravity stabilizer formed of at least one weighted member attached by a flexible cord to the terminal end of the portion extending along the central longitudinal axis of the kite.

5. A delta shaped inflatable kite having a single inflatable chamber formed of a bulbous nose portion and three frusto-conically shaped tubular portions forming structural beams extending from the nose portion toward the tail section, one beam extending along the central longitudinal axis of the kite, the other two beams forming the leading edges of the kite, two forwardly-extending, generally triangular shaped uninflated areas forming airfoils, one located between the central beam and each edge beam, means to fill the inflatable chamber, and string attaching means formed of a T-shaped member having an elongated leg portion and an elongated cross-bar, a plurality of string attaching locations spaced along the leg portion, the string attaching member securely attached by said cross-bar to the underside of the kite approximate the intersection of the central longitudinal axis and a lateral axis perpendicularly intersecting the longitudinal axis at the flying point of the kite.

6. An inflatable kite formed of two layers of plastic having an outline forming the configuration of the kite, the two layers being secured together to form at least one inflatable air chamber, the kite having a central longitudinal axis, a pendulum-like gravity stabilizer secured to the tail end of the kite approximate the longitudinal axis, the stabilizer comprising at least one weighted member attached to the kite by a flexible cord, and a string attaching member secured to the layer forming the underside of the kite, the member extending along a lateral axis perpendicularly intersecting the central longitudinal axis approximate the flying point of the kite, the member having a series of locations extending along the lateral axis for attaching the string.

7. An inflatable kite comprising two generally delta-like shaped layers of lightweight, gas impervious material, the layers being sealed along the sides of the delta and along lines that extend inwardly from the base, inflating means, the kite when inflated having an overall general deltoid configuration formed of a single air chamber having a large bulbous nose portion and three generally frusto-conical beams, one beam extending along the central longitudinal axis and the other two beams extending along the sides and two uninflated portions, one uninflated portion between the central beam and each of the side beams to form a pair of gull-wing airfoils, and a tethering string attaching means attached to central beam along the central longitudinal axis at approximately three-fifths of the distance from the nose to the base, a single tethering string attached solely to the tethring string attaching means whereby the kite reacts as an aerodynamic device and the angle of the tethering string to the ground is in excess of thirty degrees.

8. The kite specified in claim 7 wherein the string attaching means is formed of an elongated member having an arm portion attached to the underside of the kite and a stem portion which extends outwardly from the arm portion, the stem portion having a plurality of string attaching locations spaced along its length.

9. The kite specified in claim 8 wherein the elongated arm portion extends along a line which perpendicularly intersects the central longitudinal axis.

10. The kite specified in claim 7 wherein the string attaching means is formed of a T-shaped member, having an elongated cross-arm and an elongated stem, the cross-arm being secured to the kite and a plurality of string attaching locations spaced along the length of the elongated stem.

* * * * *